US005641923A

United States Patent [19]

Merski

[11] Patent Number: 5,641,923

[45] Date of Patent: Jun. 24, 1997

[54] DETACHABLE TREMOLO ARM AND KIT THEREFOR, AND METHODS OF CONSTRUCTING AND UTILIZING SAME

[76] Inventor: Ronald F. Merski, 9570 Kinloch, Redford, Mich. 48239

[21] Appl. No.: 485,100

[22] Filed: Jun. 7, 1995

[51] Int. Cl.[6] ..... G10D 3/00

[52] U.S. Cl. ..... 84/313; D17/21

[58] Field of Search ..... 84/313, 453; D17/21

[56] References Cited

U.S. PATENT DOCUMENTS

| | | | |
|---|---|---|---|
| D. 169,120 | 3/1953 | Bigsby | D17/21 |
| D. 170,109 | 3/1953 | Bigsby | D17/21 |
| D. 194,067 | 11/1962 | Burns | D17/21 |
| D. 196,678 | 10/1963 | Webster | D17/21 |
| D. 212,780 | 11/1968 | McCarty et al. | D17/21 |
| 4,457,201 | 7/1984 | Storey | 84/313 |
| 4,768,416 | 9/1988 | Boyer | 84/453 |
| 4,852,448 | 8/1989 | Hennessey | 84/313 |

*Primary Examiner*—Michael L. Gellner
*Assistant Examiner*—Shihyung Hsieh
*Attorney, Agent, or Firm*—Weiner, Carrier & Burt, P.C.; William F. Esser; Irving M. Weiner

[57] ABSTRACT

A tremolo arm for use in association with a guitar or other stringed musical instrument. The tremolo arm comprises a first rod member for attaching to a guitar bridge; and a decorative display member which removably attaches to a second end portion of the rod member. The decorative display member is substantially selectively fixed to the rod member by the use of a set screw, a cotter-type pin, a snap mechanism, or by being molded thereto.

11 Claims, 2 Drawing Sheets

DETACHABLE TREMOLO ARM AND KIT THEREFOR, AND METHODS OF CONSTRUCTING AND UTILIZING SAME

BACKGROUND OF THE INVENTION

1. Field of Invention

This invention relates to a detachable tremolo arm and in particular to a decorative tremolo arm and corresponding kit of differently decorated tremolo arms which attach to a guitar for simultaneously creating a vibrato effect and providing an atheistical pleasing appearance for a guitar or other stringed musical instrument.

2. Description of the Relevant Art

There are know tremolo arms for guitars or similar musical instruments. For example, Bigsby U.S. Design Pat. Nos. 169,120 and 170,109 disclose the ornamental designs of tremolo arms.

Burns U.S. Design Pat. No. 194,067 discloses the ornamental design of a tremolo unit for a stringed musical instrument.

Webster U.S. Design Pat. No. 196,678 discloses the ornamental design of a vibrato unit for a stringed musical instrument, including a curved tremolo arm.

McCarty U.S. Design Pat. No. 212,780 discloses the ornamental design of a vibrato assembly for a guitar, including a tremolo arm having a padded end portion.

The above-discussed references, however, fail to disclose a replaceable, highly decorative tremolo arm which removably attaches to a guitar or substantially standard arm piece of a tremolo arm, and fail to disclose a kit of detachable tremolo arms which are each differently decorated so as to be individually interchangeably operative with a guitar or other stringed musical instrument.

SUMMARY OF THE INVENTION

The present invention overcomes the above-discussed limitations and shortcomings of known tremolo arms for guitars or other musical instruments, and satisfies a significant need for a detachable, decorative tremolo arm and kit therefor so as to provide a vibrato effect while providing an aesthetically pleasing decoration to a guitar which represents the guitarist's then existing mood, emotions, or other expressive feelings.

According to the present invention, there is provided a tremolo arm comprised of a an elongated rod member having a first end which engages with the guitar bridge of a stringed musical instrument, a second end which extends outwardly from the guitar surface, and wherein the elongated rod member is bent at a substantially central location therealong so that rotation of the second end about the axis defined by the first end of the cylindrical member creates a vibrato effect; a display member which is attached to the second end of the rod member and having a decorative appearance; and wherein the display member is selectively removable so that any of a wide variety of display members may be interchangably used.

Alternatively, the display member is substantially permanently secured or integrally formed with the elongated rod member so as to form a unitary member. In this embodiment, the entire unit is selectively disconnected from the guitar.

In use, the decorative display member is connected to the elongated rod member. Next, the elongated rod member is attached to a guitar. Thereafter, the guitar can be played, utilizing a vibrato effect. The decorative display of the tremolo arm is optionally later replaced by detaching it from the rod member, which is already secured to the guitar, and attaching a different display member thereto.

It is an object of the invention to provide a tremolo arm for a guitar or other stringed musical instrument which is highly decorative.

Another object of the invention is to provide such a tremolo arm which is easily detached from the guitar.

It is another object of the invention to provide a kit of decorative tremolo arms which are individually interchangeable.

Other objects, advantages and salient features of the present invention will become apparent from the following detailed description, which, when taken in conjunction with the annexed drawings, discloses preferred embodiments of the present invention.

DETAILED DESCRIPTION OF THE INVENTION

Figure 1:
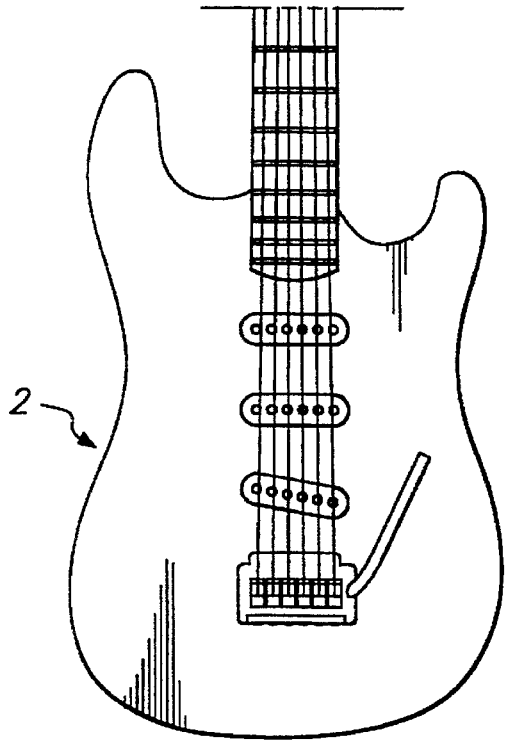
FIG. 1 is a front elevational view of a guitar having a tremolo arm connected thereto.
Figure 2:
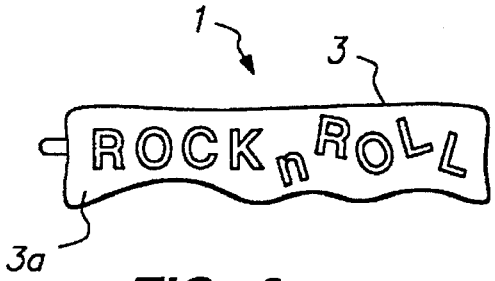
FIG. 2 is a front elevational view of a tremolo arm according to a preferred embodiment of the present invention.

Referring to FIGS. 1–12, there is shown a detachable tremolo arm 1 for a guitar 2 or other stringed musical instrument, comprising display member 3, rod 4, and an attaching means. Display member 3 and rod 4 are preferably but not necessarily constructed from a substantially rigid material, such as metal or extruded plastic, but alternatively display member 3 and rod 4 are constructed from other materials.

Rod 4 of tremolo arm 1 preferably but not necessarily has a threaded end 6 (FIG. 4) which attaches to a bridge assembly of a guitar or other stringed musical instrument by threaded engagement. Alternatively, rod 4 includes an end having concentric grooves 7 (FIG. 3) defined thereon which interact with tabs, bearings or other protrusions disposed within the tremolo arm receiving aperture of the guitar bridge, so as to form a secure engagement with the tremolo arm.

Figure 3:
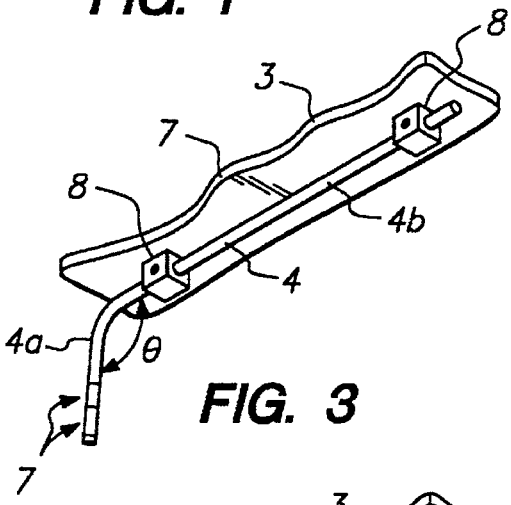
FIG. 3 is a bottom perspective view of a tremolo arm according to a preferred embodiment of the present invention.

According to the preferred embodiments of the present invention, rod 4 includes a first portion 4*a* which extends outwardly from the front face of the guitar when tremolo arm 1 is connected thereto, and a second rod portion 4*b* which is positioned at an angle relative to first portion 4*a* so as to form a substantially obtuse angle θ therewith (FIG. 3). In this way, rod 4 performs a crank-like function when connected to a stringed instrument. By rotating second rod portion 4*b* about the longitudinal axis formed by first rod portion 4*a*, the bridge of the associated stringed instrument is worked so as to create a vibrato effect. As shown in FIGS. 3–6, the bend in rod 4, thereby forming first rod portion 4*a* and second rod portion 4*b*, is located in a substantially central location along rod 4.

According to the preferred embodiments of the present invention, display member 3 attaches to the second end of rod 4 and is highly decorative so as to form an aesthetically pleasing attachment to a stringed musical instrument. In a preferred embodiment, display member 3 comprises a face-plate having a decorative surface 3*a* (FIG. 2) and a second surface 3*b* (FIG. 5) to which rod 4 is attached. Decorative surface 3*a* preferably but not necessarily includes any of a wide variety of decorative features, including words and/or phrases, symbols, diagrams, or a combination thereof. Such decorative letters or symbols may preferably be embossed or engraved onto surface 3*a*.

Display member 3 may additionally or alternatively be shaped, molded, engraved and/or otherwise worked to resemble any object, including but not limited to a lightening bolt, snake, or dagger.

Display member 3 preferably but not necessarily includes at least one curved edge 7 which is formed so as to allow tremolo arm 1 to be comfortably grasped, as shown in FIGS. 3–7. By having recesses defined along edge 7 so as to form a handgrip, tremolo arm 1 may be comfortably utilized for an extended period of time.

The present invention preferably but not necessarily includes a means for attaching display member 3 to rod 4. The attaching means preferably but not necessarily allows display member 3 to be selectively attached to rod 4, so that display member 3 is substantially interchangeable with other display members 3.

In one preferred embodiment of the present invention, the attaching means comprises one or more housings 8 (FIGS. 3 and 7) which extend from surface 3*b* of display member 3, having an aperture A defined therethrough for slidably receiving second rod portion 4*b* and a threaded recess R defined laterally through housing 8; and screw 9, which threadingly engages with threaded recess R of housing 8 so that the threaded end of screw 9 contacts rod 4 and substantially locks it in place when rod 4 and screw 9 are engaged with housing 8.

Housings 8 are preferably but not necessarily integrally formed with display member 3 so as to form a unitary member.

Figure 8:
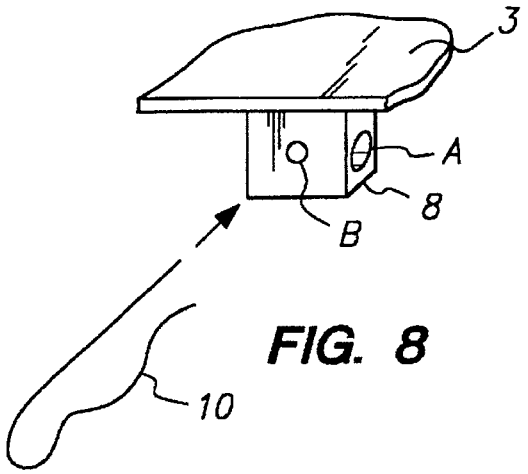
FIG. 8 is a partial side elevational view of the tremolo arm of the present invention shown in FIG. 3.
Figure 9:
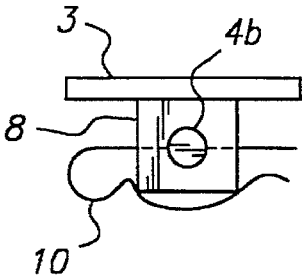
FIG. 9 is an end elevational view of the tremolo arm of the present invention shown in FIG. 3.

In a second preferred embodiment, the attaching means comprises cotter pin 10; and housings 8 having a first aperture A defined longitudinally therethrough for slidably receiving second rod portion 4*b*, and a second aperture B defined laterally through housing 8 for slidably receiving cotter pin 10, as shown in FIGS. 8 and 9. By defining an aperture through second rod portion 4*b*, cotter pin 10 substantially locks display member 3 onto rod 4 by inserting pin 10 through housing 8 and rod 4.

Figure 6:
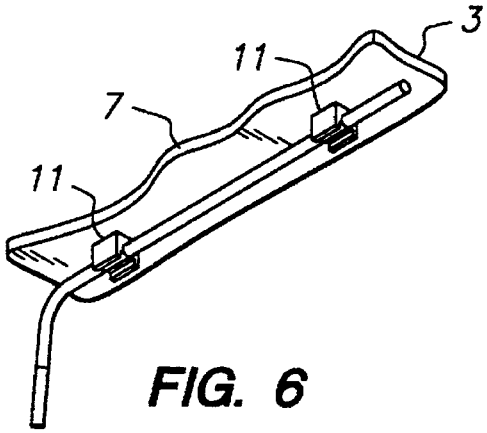
FIG. 6 is a bottom perspective view of a tremolo arm according to another preferred embodiment of the present invention.
Figure 7:
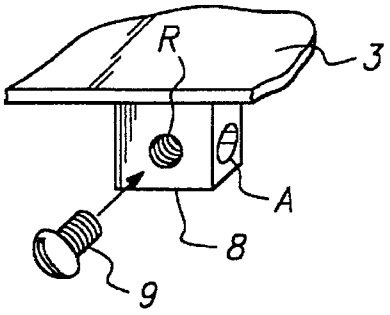
FIG. 7 is a partial side elevational view of the tremolo arm of the present invention shown in FIG. 3.
Figure 10:
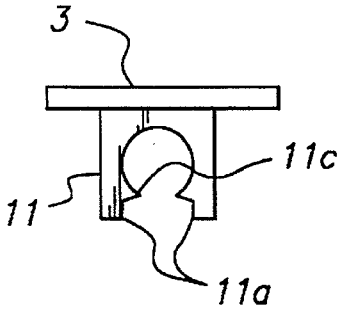
FIG. 10 is an end elevational view of the tremolo arm of the present invention shown in FIG. 6.

In a third preferred embodiment, the attaching means comprises at least one extension member 11 which extends outwardly from surface 3*c* of display member 3. Referring to FIGS. 6 and 10, each extension member 11 preferably but not necessarily includes a recess defined by resilient tab members 11*a*. The outwardly extending portions of tab members 11*a* preferably temporarily flex away from each other due to hand applied pressure in order to receive rod 4 within the recess. As shown in FIG. 10, each tab member 11*a* preferably but not necessarily includes lateral protrusions 11*c* so as to securely maintain rod 4 within slot 11*b*. Additionally, rod 4 and extension members 11 may include serations for ensuring secure engagement between rod 4 and display member 3.

Figure 12:
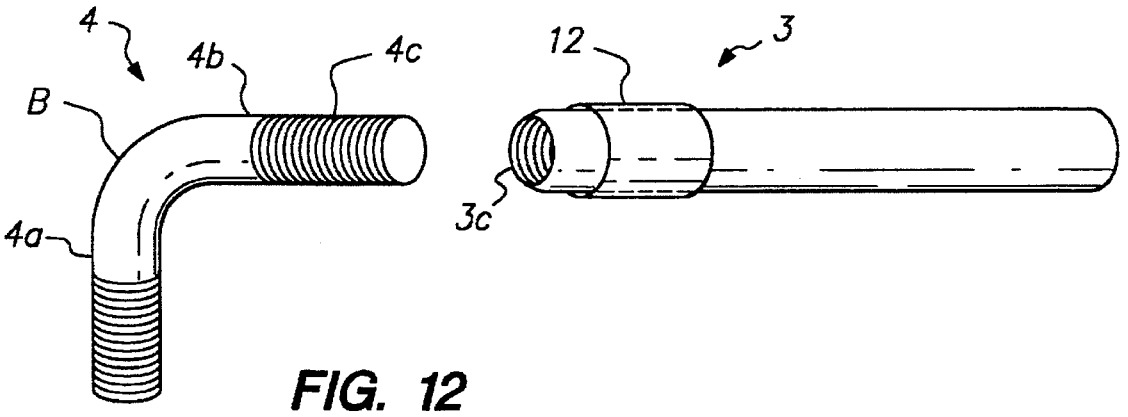
FIG. 12 is a perspective view of the tremolo arm of a preferred embodiment of the present invention.

In a fourth preferred embodiment, the present invention comprises rod 4 having second rod portion 4*b* having a threaded end 4*c*, and display member 3 having an aperture 3*c* defined therein for removably engaging with threaded end 4*c*, as shown in FIG. 12. Aperture 3*c* is preferably but not necessarily defined along a substantially longitudinal axis of display member 3, but alternatively aperture 3*c* is defined along a substantially lateral axis.

In addition, the fourth preferred embodiment may preferably but not necessarily includes a means for substantially preventing cracking or other fatigue on display member 3 along aperture 3*c*, in the event display member 3 is constructed from a breakable material, such as rigid plasic. The preventing means preferably but not necessarily comprises a sleeve 12 defined over display member 3, as shown in FIG. 12. As a result, if threaded end 4*c* is forced into a substantially extremely tightened engagement with display member 3 so that the opening of aperture 3*c* is widened when it encounters bend B, sleeve 12 substantially limits such widening of the opening of aperture 3*c*, thereby substantially preventing the opening from splitting.

The preferred embodiments of the present invention preferably includes a plurality of interchangeable display members 3, each of which has a different decorative appearance, so that the guitarist can choose any one of the display members 3 for use in decorating a guitar. In this way, the guitarist is capable of choosing the particular display member 3 which best fits the guitarist's then-existing mood, the type of music to be played, or even the particular sponsor of the musical performance.

In use, rod 4 is connected to the guitar using the first end of rod 4 to engage therewith. Next, the desired display member 3 is selected and attached to rod 4. In a first embodiment, rod portion 4*b* is slidaby inserted within housing 8 and screw 9 is tightened therein until screw 9 substantially locks display member 3 to rod 4. In a second embodiment, rod portion 4*b* is slidably inserted within housing 8 and pin 10 is inserted therein so as to prevent rod 4 from further movement relative to housing 8. In a third embodiment, rod 4 is urged between extension members 11 by finger applied pressure, thereby causing tab members 11*a* to slightly temporarily displace so as to allow rod 4 to be inserted therebetween and into engagement with display member 3. Thereafter, a vibrato effect is created by rotating display member 3 about the longitudinal axis defined by rod portion 4*a* of rod 4.

Although there has been described what is at present considered to be the preferred embodiments of the present invention, it will be understood that the invention can be embodied in other specific forms without departing from the spirit or essential characteristics thereof.

For example, display member 3 can be worked or otherwise formed into any shape. By display member 3 being constructed from an easily moldable composition, such as plastic, the number of possible decorative appearances is substantially endless. In addition, the decorative feature may be due to the very nature of the material from which display member 3 is constructed, such as display member 3 being constructed from wood, ivory, or even a transparent material like glass, crystal or plastic.

Figure 5:
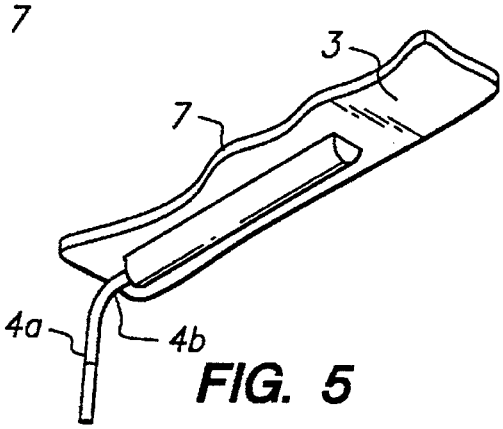
FIG. 5 is a bottom perspective view of a tremolo arm according to a third preferred embodiment of the present invention.

In an alternative embodiment, display member 3 is substantially permanently attached to rod 4 so as to form a unitary member therewith. As shown in FIG. 5, in this alternative embodiment display member 3 is molded onto the portion **4*b* of rod 4, such as by a plastic injection molding process. Rod portion 4*b* is preferably but not necessarily has a substantially knurled end so as to ensure display member 3 is substantially fixed thereto. In this alternative embodiment, only a small portion of rod 4*a* needs to be engaged with display member 3 in order to create a substantially fixed engagement therewith. By way of one example, rod portion 4*b* extends only approximately half the length of display member 3**.

Figure 4:
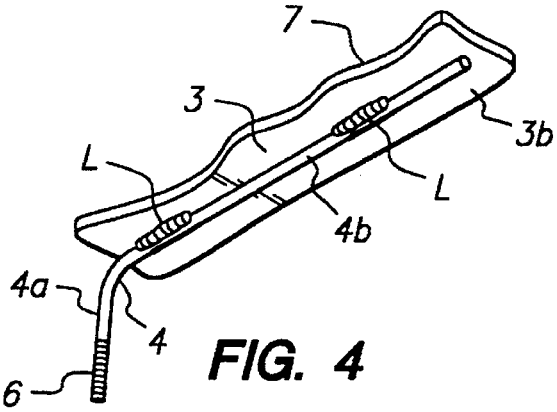
FIG. 4 is a bottom perspective view of a tremolo arm according to another preferred embodiment of the present invention.
Figure 11:
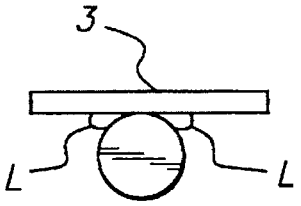
FIG. 11 is an end elevational view of the tremolo arm of the present invention shown in FIG. 4.

In a second alternative embodiment, display member 3 is substantially permanently connected to rod 4. As shown in FIGS. 4 and 11, rod 4 and display member 3 are constructed from a metal such as steel or aluminum, and rod 4 is connected to display member 3 by welding it thereto at locations L. Optionally, rod 4 is spot welded to display member 3.

The described embodiments are, therefore, to be considered in all aspects as illustrative and not restrictive. The scope of the invention is indicated by the appended claims rather than the foregoing description.

I claim:

1. A detachable tremolo arm, comprising:

a rod member having a first end which is connected to a guitar bridge, said rod member being bent at a substantially central location thereon;

a display member which engages with said rod member at a second end thereof;

said display member includes an ornamental surface;

said display member includes means for removably attaching said display member to a second end portion of said rod member; and said attaching means comprises said second end of said rod member including a first threaded portion and said display member being associated with a second threaded portion which is selectively engaged with said first threaded portion of said rod member.

2. A tremolo arm as recited in claim 1, wherein:

said display member includes an outwardly facing surface having an edge with recesses defined therealong so as to substantially form a handgrip.

3. A tremolo arm as recited in claim 1, wherein:

said display member includes an aperture defined therein; and said second threaded portion is defined within said aperture of said display member for selectively receiving said first threaded portion of said rod member.

4. A tremolo arm as recited in claim 3, further including a sleeve member which is telescopically engaged with said display member.

5. A kit for decorating a guitar, comprising:

a first elongated member being bent at a location along a substantially central portion thereof and having a first end which is attached to a guitar bridge so that rotation of said first end about its axis creates a tremolo effect;

a plurality of second members, each of said second members having a decorative appearance which is different from another of said second members and having means for attaching to a second end portion of said first member;

said second members are selectively removable from said first member so that said second members are individually interchangeably connected to said first member;

said second end portion of said first elongated member includes a first threaded portion; and each of said second members is operably associated with a second threaded portion disposed along an end portion thereof, said second threaded portion being selectively engaged with said first threaded portion of said first elongated member.

6. A kit as recited in claim 5, wherein:

each of said second members includes a surface having a substantially curved edge so as to form a handgrip.

7. A kit as recited in claim 5, wherein:

said first threaded portion of said first elongated member is defined along an outer surface of said first elongated member; and said second threaded portion of each of said second members is defined within an aperture associated with said second elongated member.

8. A kit as recited in claim 7, wherein:

each of said second members includes a sleeve member which is telescopically engaged with said end portion thereof.

9. A kit as recited in claim 7, wherein:

each of said second members includes a sleeve member which is operably associated with said end portion thereof and with said second threaded portion.

10. A kit as recited in claim 5, wherein:

each of said second members includes a sleeve member which is telescopically engaged with said end portion thereof.

11. A kit as recited in claim 5, wherein:

each of said second members includes a sleeve member which is operably associated with said end portion thereof and with said second threaded portion.

* * * * *